United States Patent [19]

Mo

[11] 4,302,130

[45] Nov. 24, 1981

[54] GAS PLATFORM

[76] Inventor: Olav Mo, Grønsundveien 94, 1360 Nesbru, Norway

[21] Appl. No.: 22,645

[22] Filed: Mar. 21, 1979

[30] Foreign Application Priority Data

Mar. 30, 1978 [NO] Norway ..... 781109

[51] Int. Cl.[3] ..... E02B 17/00; E02D 29/00; E02D 29/06; F17C 1/00

[52] U.S. Cl. ..... 405/210; 405/205; 405/211

[58] Field of Search ..... 405/210, 211, 203, 205, 405/195

[56] References Cited

U.S. PATENT DOCUMENTS

| | | | |
|---|---|---|---|
| 2,748,739 | 6/1956 | Monti et al. | 405/210 X |
| 3,572,278 | 3/1971 | Knapp et al. | 405/210 X |
| 3,675,431 | 7/1972 | Jackson | 405/210 |
| 3,727,418 | 4/1973 | Glazier | 405/210 X |
| 3,824,795 | 7/1974 | Mo | 405/210 X |
| 3,913,335 | 10/1975 | Heien | 405/210 |
| 4,007,700 | 2/1977 | Haynes et al. | 405/210 X |
| 4,014,177 | 3/1977 | Jarlan | 405/210 X |
| 4,188,157 | 2/1980 | Vigander | 405/210 |

FOREIGN PATENT DOCUMENTS

| | | | |
|---|---|---|---|
| 1684606 | 1/1973 | Fed. Rep. of Germany | 405/210 |

*Primary Examiner*—Stephen J. Novosad
*Attorney, Agent, or Firm*—Larson and Taylor

[57] ABSTRACT

The invention is related to an offshore platform with storage facilities for natural resources, such as LNG. The invention is particularly concerned with the problem of providing sufficient safety in storing such products, e.g., protection against collision with tankers.

6 Claims, 3 Drawing Figures

8
1
2
11
3
12

GAS PLATFORM

It is known to load oil directly from a concrete gravity platform to a tanker. One concept is shown in Norwegian Patent Application No. 76.3435 where the platform has at least one tower projecting above the sea level where the platform is equipped with devices for loading, unloading and mooring of a tanker. These devices are revolvingly arranged around a vertical axis on the platform in such a manner that the platform also is serving as a single point mooring for the tanker.

It is also known that the concept "Subtank" is proposed to be equipped with a loading arrangement where the tanker is moored directly to the lower submerged part of the platform, and where the loading is carried out through a floating hose.

The problem with the known concepts is safety. One can ask what would happen if a tanker for some reason should collide with a tower and destroy it. For the known concepts such an accident would be very severe. It has therefore shown that the concepts mentioned have had problems to be accepted.

The object of the invention is to overcome the problems outlined above.

According to the present invention, a platform is provided which comprises concrete cells. Inside these cells are placed separate storage tanks below sea level. The cells are airfilled the tanks are under atmospheric pressure. The storage tanks are cylindrical in shape and include a convex termination at each end thereof.

Other features of the invention will be discussed below in connection with an exemplary embodiment.

Figure 1:
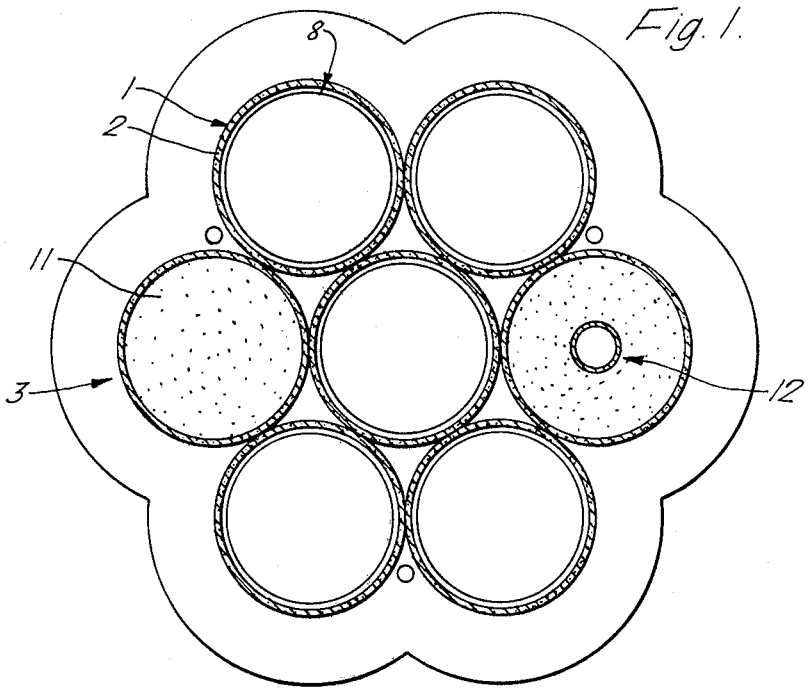
FIG. 1 shows a horizontal section through that part of the platform which contains the storage tanks.

The platform 1 comprises a submerged base structure 2 consisting of cells 3. The platform also comprises at least four towers 4 and 5, which are formed by cells 3 which are elongated above the sea level 6. The platform also comprises a deck structure 7 which is carried by the towers 4 and 5.

In the present example all the seven cells 3 are elongated to form towers. We therefore have six peripheral towers 4 and one central tower 5. Five out of the cells 3 contain storage tanks 8. These could be of known design consisting of isolated steel tanks standing on a steel skirt 9 which is again founded on a concrete wall 10.

Two of the cells 3 contain ballast 11. This is necessary to prevent that the platform will float up when the storage tanks are empty. One ballast cell contains a cylinder 12, where there is placed equipment, as for example pumps.

The most important, possibly all, piping to the storage tanks goes from the deck through the tower 5. Further, the piping goes through the tunnels 13 to the storage tanks. The peripheral towers 4 have protection caps 14 with hatches 15. The tunnels can also be closed by hatches 16.

A horizontal beam structure 17 is surrounding the peripheral towers. Upon the beams 17 there are placed rails where a mooring trolley 18 is running. A tanker 19 could be moored to the mooring trolley 18 which can follow the tanker when it swings around the platform according to the wind and weather.

Loading of the tanker is carried out through arms 20 which could carry hoses 21. The arms 20 are fixed, but able to revolve. It is therefore necessary to have several arms always to have one in position as the tanker swings around the platform.

As it can be seen, the towers 4 and the beam 17 will form a protective structure around the tower 5. The tanker can therefore not hurt the tower 5 unless it first completely destroys the beam 17 and/or a tower 4. By relevant dimensioning one can therefore for all practical cases avoid damage to the important devices which are placed in the tower 5.

Usually the hatches 15 will be closed. If a tower 4 is damaged, the tower itself will therefore be filled with water, but the storage tank 8 will be protected by the watertight structures 14 and 15. When loading is not going on, the hatches 15 can be opened and one has direct access for maintenance of the tanks 8.

The tunnels 13 can be used for escape in case of for instance fire in the main access routes.

The deck 7 should be constructed to remain intact, laying on the remaining towers, if one tower 4 is destroyed.

The beam 17 should preferably be constructed as a strong tube structure of concrete.

On the deck 7 usual production equipment could be placed. If the platform 1 should be utilized as a refrigeration and loading platform for LNG, one should place the refrigeration equipment on the deck and equip the tanks 8 for storing of LNG.

If the walls of the tanks 8 are placed at a distance of approximately 1 meter from the inner side of the cell walls 3, one has sufficient space for maintenance around the tanks 8.

A small leakage in the concrete will cause water to be collected at the bottom of the cells 3. From there the water will be piped to the cylinder 12 where it will be pumped overboard.

If the storage is to be used for oil, there will normally be no use for special tanks 8. One will use the cells 3 themselves, below the structures 14 and 15, for storage.

The tanks 8 could be constructed in a similar way as the well-known spherical tanks for LNG. But to better utilize the voids in the concrete structure, they should be somewhat modified. The tanks shown are hemispherical (semi-globular) in the upper and lower end, and cylindrical in the middle part, with vertical axis. As the concrete cells are also cylindrical or at least near cylindrical, this will give a good utilization of the void present. There should be approximately 1 meter between the outer side of the storage tank and the inner side of the concrete cell.

The concrete cells 3 are designed to resist full water pressure, and the storage tanks 8 will therefore be under atmospheric conditions.

The tanks 8 are constructed of normal materials, which may be some kind of metal. On the outer side they are isolated.

The ballast 11 will normally have to be filled offshore, after the installation of the platform.

The platform may of course have other configurations than that shown. It may consist of a different number of cells and towers, and it is not necessary that all the cells 3 are elongated to form towers.

Figure 2:
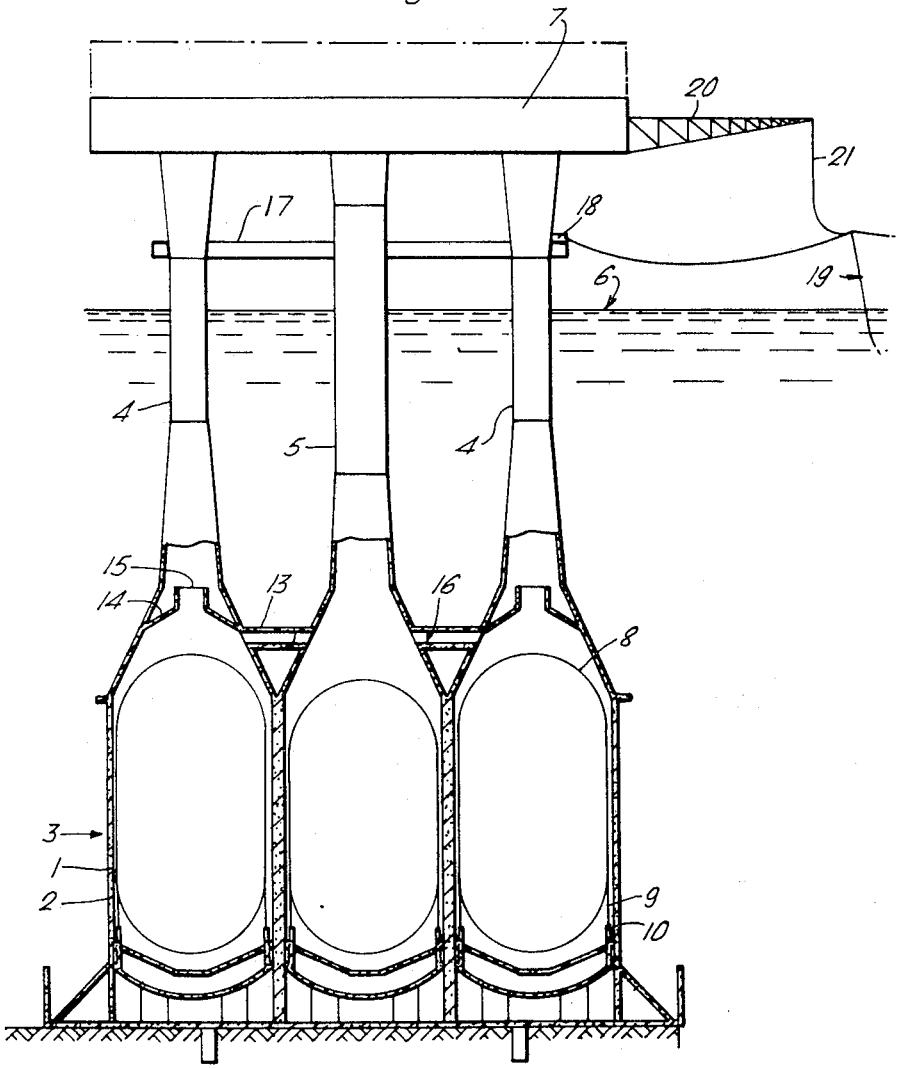
FIG. 2 shows a vertical section through the platform.
Figure 3:
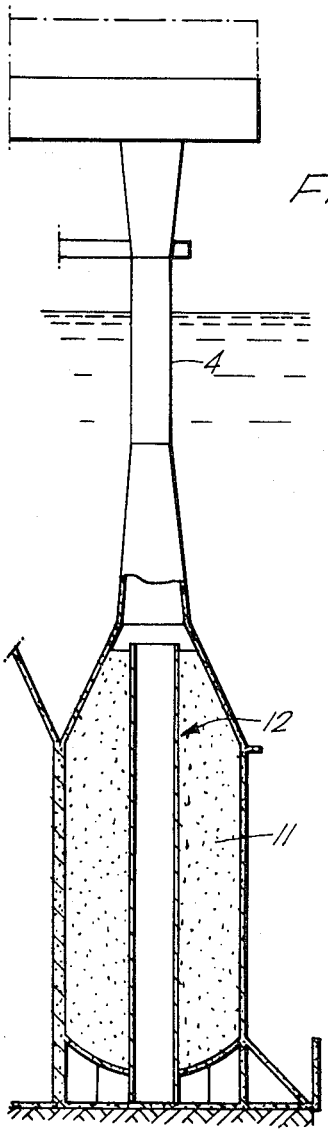
FIG. 3 shows another vertical section through a part of the platform.

The principle of separate storage tanks placed inside a concrete caisson could be used also if there is less than four towers. There may be only one tower. In this case the other cells 3 will be terminated under water, for instance by a concrete dome. Access from a terminated cell to a tower could be through tunnels similar to those shown at FIG. 2.

The platform could also be used for drilling. The conductors could be placed either within the towers or in the open sea inside the protective beam 17.

Construction of the platform is carried out according to the usual principles for gravity platforms. The tanks 8 could be prefabricated, and could be mounted by crane when the cell walls 3 are finished, but before the construction of the towers is started.

The platform 1 could also be a floating platform.

I claim:

1. An offshore platform with a storage facility for storing natural products such as liquid gas, said platform comprising a plurality of concrete cells, a plurality of storage tanks, individual ones of said tanks being respectively disposed within individual ones of said concrete cells below sea level and being completely exposed to atmospheric conditions, said storage tanks being cylindrical in shape and including a convex curved termination portion at both ends thereof, said tanks being oriented with the longitudinal axis thereof upright, each of said plurality of tanks being supported by a skirt structure formed by extension of the cylindrical tank wall.

2. An offshore platform according to claim 1, wherein at least one concrete cell which has a storage tank disposed therein is elongated so as to extend above sea level so as to provide a direct vertical access from above sea level down to the storage tank.

3. An offshore platform according to claim 2, where the elongated cell includes a watertight barrier with a hatch disposed above the storage tank.

4. An offshore platform according to claim 1 wherein at least one of said concrete cells is elongated so as to extend above sea level.

5. An offshore platform with a storage facility for storing natural products such as liquid gas, said platform comprising one central and six peripheral cells, all of the seven cells extending above the sea level, at least one of said cells containing a storage tank disposed therein below sea level under atmospheric conditions, said storage tank being cylindrical in shape and including a convex curved termination portion at both ends thereof.

6. An offshore platform according to claim 5 comprising at least one tunnel located at the upper end of the cells connecting the said central cell with one of the peripheral cells.

* * * * *